US008850745B2

(12) United States Patent
Sofianek et al.

(10) Patent No.: US 8,850,745 B2
(45) Date of Patent: Oct. 7, 2014

(54) WINDOW COUNTERBALANCE SYSTEM AND MOUNTING BRACKET THEREFOR

(71) Applicant: Caldwell Manufacturing Company North America, LLC, Rochester, NY (US)

(72) Inventors: Jay Sofianek, Webster, NY (US); Richard S. DeNormand, Victor, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 13/826,734

(22) Filed: Mar. 14, 2013

(65) Prior Publication Data

US 2014/0000172 A1 Jan. 2, 2014

Related U.S. Application Data

(60) Provisional application No. 61/759,007, filed on Jan. 31, 2013, provisional application No. 61/665,558, filed on Jun. 28, 2012.

(51) Int. Cl.
*E05F 1/00* (2006.01)

(52) U.S. Cl.
USPC ..... 49/447; 16/197

(58) Field of Classification Search
USPC ..... 49/445, 446, 447, 448; 16/193, 197, 16/198, 400, 401, DIG. 16
See application file for complete search history.

(56) References Cited

U.S. PATENT DOCUMENTS

| | | | | |
|---|---|---|---|---|
| 3,869,754 | A * | 3/1975 | Foster | 16/197 |
| 5,353,548 | A | 10/1994 | Westfall | |
| 5,463,793 | A | 11/1995 | Westfall | |
| 5,661,927 | A * | 9/1997 | Polowinczak et al. | 49/447 |
| 6,606,761 | B2 | 8/2003 | Braid et al. | |
| 6,990,710 | B2 | 1/2006 | Kunz et al. | |
| 7,735,191 | B2 | 6/2010 | Tuller | |

(Continued)

FOREIGN PATENT DOCUMENTS

WO WO 2011/100280 8/2011

OTHER PUBLICATIONS

"Caldwell Roller-Tilt Balance Systems" Caldwell [Brochure], Caldwell Manufacturing Company, Jan. 1999, p. 1-15.

(Continued)

*Primary Examiner* — Jerry Redman
(74) *Attorney, Agent, or Firm* — Harness, Dickey & Pierce, P.L.C.

(57) ABSTRACT

A window balance assembly may be in a window jamb channel to provide a biasing force urging a window sash toward an open position. The window balance assembly may include a carrier, a spring element and a mounting bracket. The spring element may include first and second portions. The first portion may be coupled to the carrier. The mounting bracket may include a latch, a first head portion, and a first projection. The latch may engage the second portion of the spring element. The first head portion may be configured to abut a first wall of the window jamb channel when the window balance assembly is installed in the window jamb channel. The projection configured to extend through and engage an aperture in a second wall of the window jamb channel when the window balance assembly is installed in the window jamb channel.

22 Claims, 9 Drawing Sheets

(56) References Cited

U.S. PATENT DOCUMENTS

| | | | | |
|---|---|---|---|---|
| 8,539,642 | B2 * | 9/2013 | Baker | 16/197 |
| 8,561,260 | B2 * | 10/2013 | Baker et al. | 16/193 |
| 2002/0104189 | A1 * | 8/2002 | Braid et al. | 16/197 |
| 2004/0163209 | A1 | 8/2004 | Pettit | |
| 2008/0178424 | A1 * | 7/2008 | Tuller | 16/193 |
| 2008/0178425 | A1 * | 7/2008 | Tuller | 16/197 |

OTHER PUBLICATIONS

"Inverted Balance Constant Force" Amesbury [Brochure], Amesbury Window Hardware, Sep. 2010, one page.

* cited by examiner

WINDOW COUNTERBALANCE SYSTEM AND MOUNTING BRACKET THEREFOR

CROSS-REFERENCE TO RELATED APPLICATIONS

This application claims the benefit of U.S. Provisional Application No. 61/759,007, filed on Jan. 31, 2013, and U.S. Provisional Application No. 61/665,558, filed on Jun. 28, 2012. The entire disclosures of each of the above applications are incorporated herein by reference.

FIELD

The present disclosure relates to a window counterbalance system and a mounting bracket for the window counterbalance system.

BACKGROUND

This section provides background information related to the present disclosure and is not necessarily prior art.

Modern window assemblies in residential, commercial and industrial buildings may include one or more window sashes that are movable within a window jamb. Window sashes that move vertically to open and close often include two or more window balance assemblies. The balance assemblies urge the window sash upward (i.e., toward an open position for a lower sash or toward a closed position for an upper sash) to assist a user in moving the window sash and to retain the window sash at a position selected by the user.

SUMMARY

This section provides a general summary of the disclosure, and is not a comprehensive disclosure of its full scope or all of its features.

In one form, the present disclosure provides a window balance assembly for installation in a window jamb channel. The window balance assembly may include a carrier, a spring element and a mounting bracket. The spring element may include first and second portions. The first portion may be coupled to the carrier. The mounting bracket may include a latch, a first head portion, and a first projection. The latch may engage the second portion of the spring element. The first head portion may be configured to abut a first wall of the window jamb channel when the window balance assembly is installed in the window jamb channel. The projection configured to extend through and engage an aperture in a second wall of the window jamb channel when the window balance assembly is installed in the window jamb channel.

In some embodiments, the latch may be disposed vertically between the projection and the head portion.

In some embodiments, the mounting bracket may include a second projection configured to engage another aperture in the second wall.

In some embodiments, the mounting bracket may include a second head portion configured to abut the first wall of the window jamb channel.

In some embodiments, the mounting bracket may include a pair of latches, and wherein each of the latches is disposed on a same end of the mounting bracket as a corresponding one of the first and second head portions.

In some embodiments, the mounting bracket may include a body portion from which the latch, first and second head portions and the first projection extend. The first projection may extend from a first side of the body portion in a first direction. The first and second head portions may extend from the body portion in a second direction that is opposite the first direction.

In some embodiments, the first projection may be disposed between the first and second head portions.

In some embodiments, the body portion may be spaced apart from the first wall when the first and second head portions are contacting the first wall.

In some embodiments, the projection may be slidably received in an aperture in the body portion and may be movable therein between a retracted position and an extended position.

In some embodiments, the first and second head portions may cooperate with a body portion of the mounting bracket to form a generally U-shape.

In some embodiments, the carrier may include an upper body portion, a lower body portion and an elongated central portion. The lower body portion may rotatably engage a cam. The elongated central portion may extend between the upper body portion and the lower body portion. The elongated central portion may be resiliently flexible to allow movement of the lower body portion relative to the upper body portion.

In some embodiments, the elongated central portion may include a pair of flexible legs that define a channel therebetween that is aligned with a slot in the cam and adapted to receive a portion of a pivot bar of a window sash.

In another form, the present disclosure provides a window balance assembly for installation in a window jamb channel. The window balance assembly may include a carrier, a spring element and a mounting bracket. The spring element may include first and second portions. The first portion may be coupled to the carrier. The mounting bracket may include a body portion, first and second head portions, and first and second projections. The body portion may include a latch engaging the second portion of the spring element. The first and second head portions may extend from the body portion in a first direction and may be configured to abut a first wall of the window jamb channel when the window balance assembly is installed in the window jamb channel. The first and second projections may extend from the body portion in a second direction and may be configured to extend through and engage first and second apertures in a second wall of the window jamb channel when the window balance assembly is installed in the window jamb channel.

In some embodiments, the latch may be disposed vertically between the first and second projections and the first and second head portions.

In some embodiments, the first and second head portions may be disposed at opposite horizontal ends of the body portion, and the latch may be disposed between the first and second head portions.

In some embodiments, the mounting bracket may include a pair of latches. Each of the latches may be disposed on a same end of the body portion as a corresponding one of the first and second head portions.

In some embodiments, the body portion may be spaced apart from the first wall when the first and second head portions are contacting the first wall.

In another form, the present disclosure provides a window balance assembly for installation in a window jamb channel. The window balance assembly may include a carrier, a spring element and a mounting bracket. The carrier may include a cam rotatably housed therein. The spring element may include a first portion coupled to the carrier and a second portion disposed within a housing. The mounting bracket may include a projection configured to extend through and engage an aperture in a second wall of the window jamb channel. The mounting bracket may also include a first end slidably engaging the housing and movable relative to the housing between a first position in which the projection does not or cannot engage the aperture and a second position in which the projection is able to engage the aperture.

In some embodiments, the mounting bracket may engage the housing in both of the first and second positions.

In some embodiments, the spring may be a curl spring and the second portion of the spring may be a curled portion. The carrier may be movable with a window sash relative to the housing and the mounting bracket.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
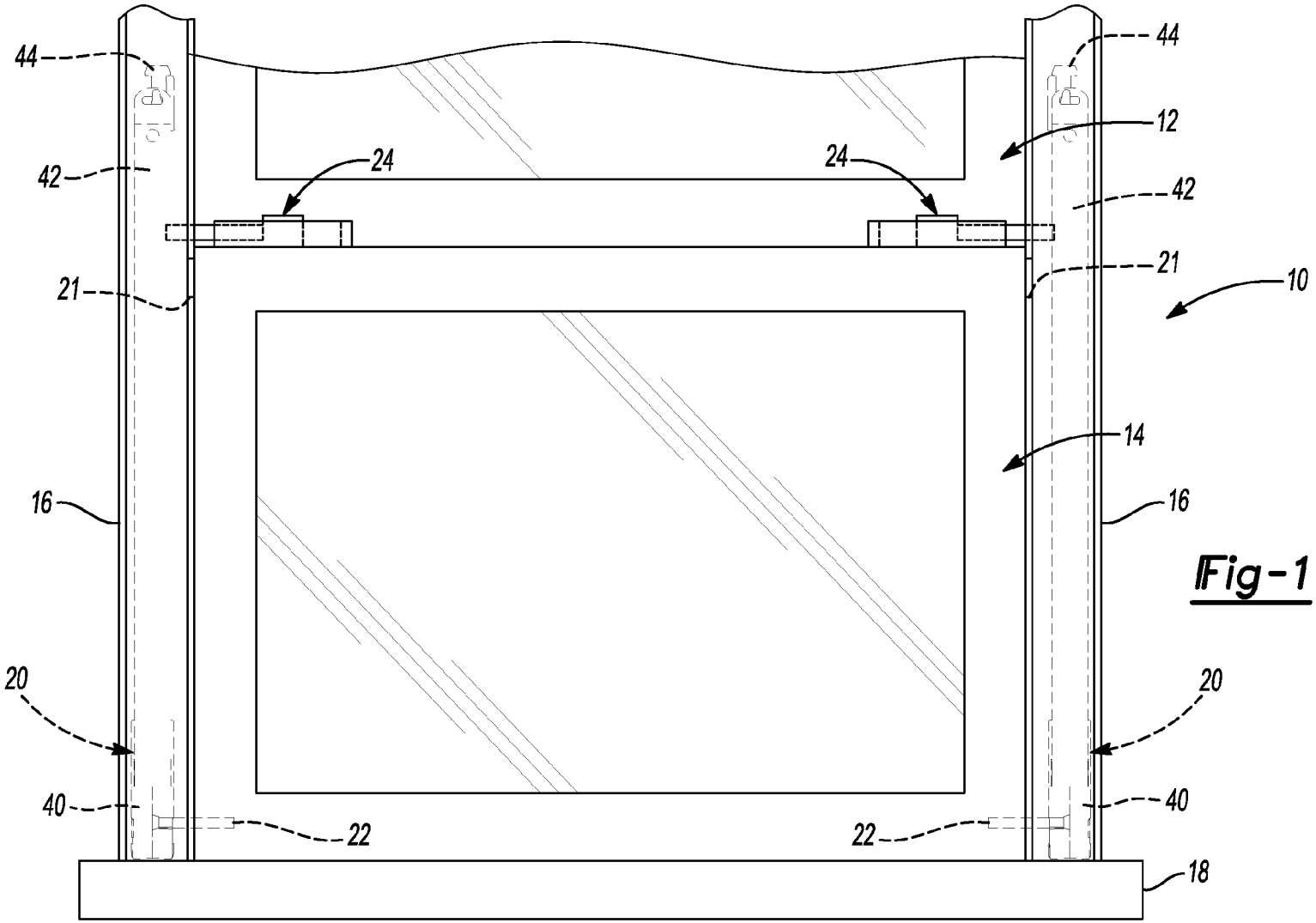
FIG. 1 is a partial front view of a window assembly including window balance assemblies according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a window assembly 10 is provided that may include an upper sash 12, a lower sash 14, a pair of window jambs 16, a window sill 18, a header (not shown) and two or more window balance assemblies or cartridges 20. In the particular embodiment illustrated in FIG. 1, the upper sash 12 is fixed relative to the window sill 18 and header (i.e., in a single hung window assembly). However, in some embodiments, the upper sash 12 may be movable relative to the window sill 18 and header between a raised or closed position and a lowered or open position (i.e., in a double hung window assembly). The lower sash 14 may be raised and lowered between open and closed positions and may be connected to the window balance assemblies 20 which assist a user in opening the lower sash 14 and maintain the lower sash 14 in a desired position relative to the window sill 18.

The lower sash 14 may include a pair of pivot bars 22 and a pair of tilt latch mechanisms 24. The pivot bars 22 may extend laterally outward in opposing directions from a lower portion of the lower sash 14 and may engage corresponding ones of the window balance assemblies 20, as will be subsequently described. The tilt latch mechanisms 24 may extend laterally outward in opposing directions from an upper portion of the lower sash 14 and may selectively engage corresponding ones of the window jambs 16. The tilt latch mechanisms 24 may be selectively actuated to allow the lower sash 14 to pivot about the pivot bars 22 relative to the window jambs 16 to facilitate cleaning of an exterior side of the window assembly 10, for example.

It will be appreciated that in a double hung window assembly, the upper sash 12 may also be connected to two or more window balance assemblies to assist the user in opening the upper sash 12 and maintaining the upper sash 12 in a selected position relative to the window sill 18. In such a window assembly, the upper sash 12 may also include tilt latches and pivot bars to allow the upper sash 12 to pivot relative to the window jambs 16 in the manner described above.

Figure 4:
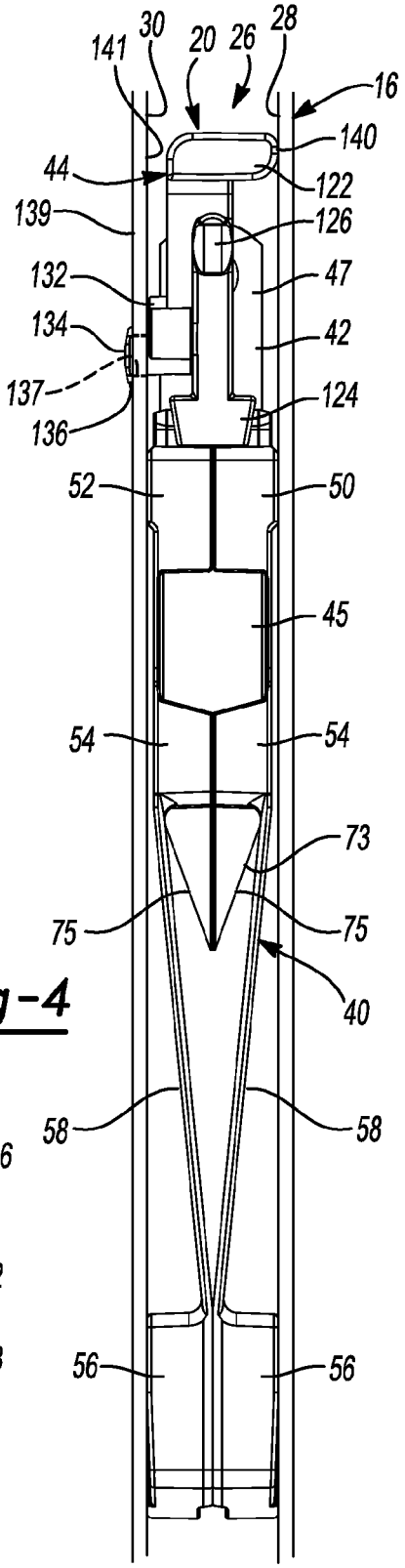
FIG. 4 is a side view of the window balance assembly installed in a window jamb channel.
Figure 5:
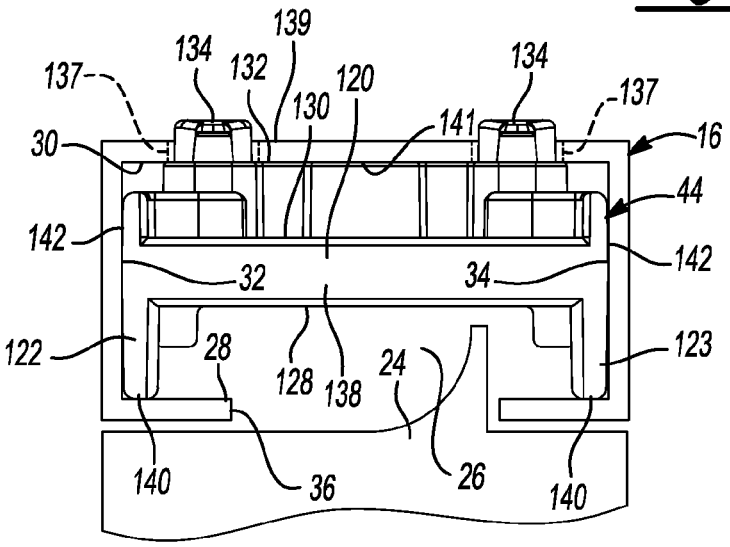
FIG. 5 is a top view of the window balance assembly installed in the window jamb channel.

As shown in FIGS. 4 and 5, each of the window jambs 16 may include a jamb channel 26 defined by a first wall 28, a second wall 30 opposite the first wall 28, and third and fourth walls 32, 34 (FIG. 5) disposed perpendicular to the first and second walls 28, 30. The first wall 28 may include a vertically extending slot 36 (FIG. 5) adjacent the lower sash 14. The window balance assembly 20 may be installed within the jamb channel 26. As shown in FIG. 1, the pivot bar 22 may extend through the slot 36 and into the jamb channel 26 to engage the window balance assembly 20. As shown in FIG. 5, the tilt latch mechanism 24 may also selectively engage the slot 36 to lock the lower sash 14 in an upright position.

Referring now to FIGS. 2-5, each window balance assembly 20 may include a carrier 40, a spring 42, and a bracket 44. The window balance assembly 20 may be modular, in that one or more of the carrier 40, spring 42 and bracket 44 shown in FIGS. 2-8 can be replaced with a different carrier, spring and/or bracket to suit a given application or set of specifications. It will also be appreciated that one or more of the carrier 40, spring 42 and bracket 44 could be incorporated into other configurations or types of window balance assemblies (e.g., moving-coil, fixed-coil, constant-force, non-constant-force, etc.). Furthermore, while the figures illustrate window balance assemblies having a single spring 42, in some embodiments, two or more springs 42 could be incorporated into a single window balance assembly to increase a spring capacity of the window balance assembly.

Figure 2:
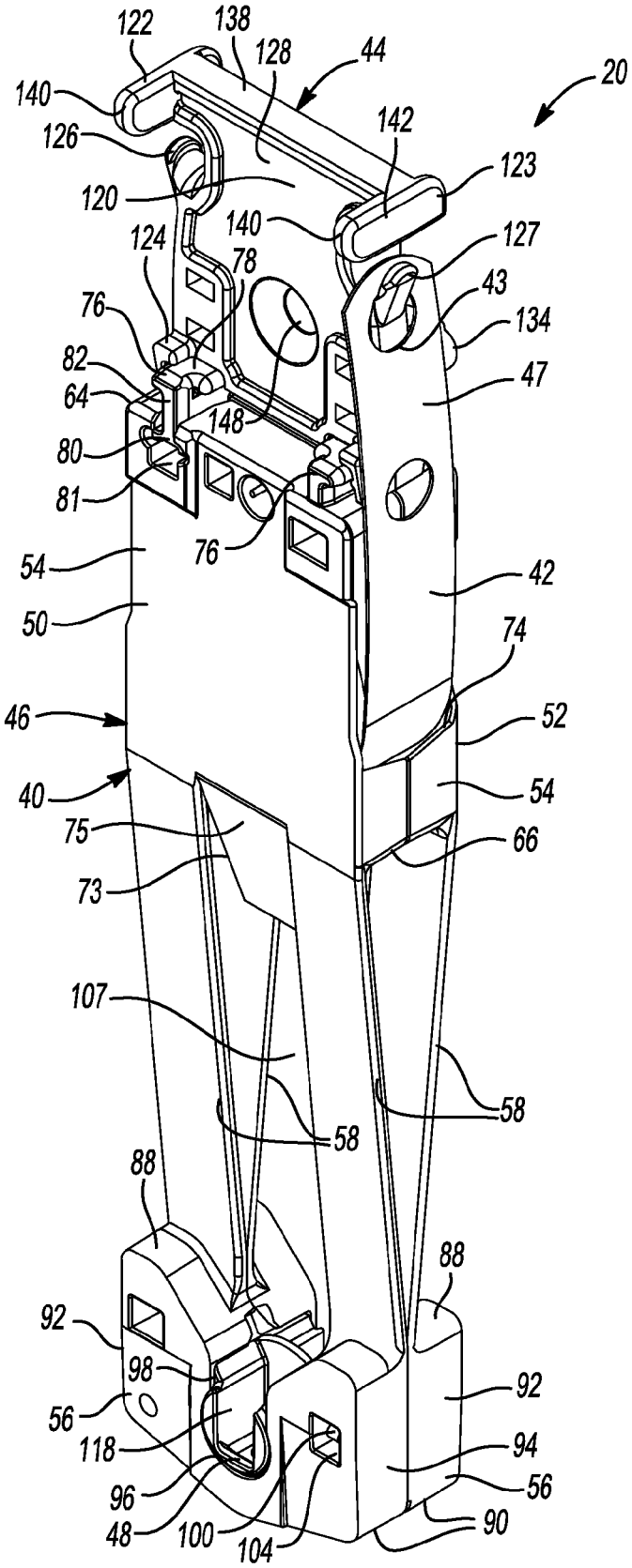
FIG. 2 is a perspective view of one of the window balance assemblies of FIG. 1.

The window balance assembly 20 shown in FIG. 2 may be a moving-coil type window balance assembly, as the spring 42 and carrier 40 may be vertically movable with the lower sash 14 relative to the window jamb 16 and the bracket 44 may be fixed relative to the window jamb 16 when the window balance assembly 20 is fully installed. The carrier 40 (also referred to as a shoe) may engage the pivot bar 22, which in turn, may engage the lower sash 14. The carrier 40 may house a curled portion 45 (FIG. 4) of the spring 42. The bracket 44 may engage an uncurled end 47 of the spring 42 and may be fixed relative to the window jamb 16 when the window balance assembly 20 is fully installed within the window jamb 16. The spring 42 may resist being uncurled such that the spring 42 exerts an upward force on the carrier 40, thereby biasing the lower sash 14 upward toward the open position.

Referring now to FIGS. 2 and 4, the carrier 40 may include a body 46 and a cam 48. The body 46 can be molded and/or machined from a polymeric or metallic material, for example, and may include first and second housing portions 50, 52. In some embodiments, the first and second housing portions 50, 52 may be similar or identical components that can engage each other to form a housing for the spring 42 and the cam 48. Each of the first and second housing portions 50, 52 may include an upper body 54, a lower body 56 and a pair of legs 58 extending between the upper and lower bodies 54, 56. It will be appreciated that in some embodiments, the body 46 could be formed from a single piece or in any other suitable manner.

The upper body 54 may include a top end 64 and a bottom end 66. When the first and second housing portions 50, 52 are assembled together, the first and second housing portions 50, 52 cooperate with each other to form a nest that receives the curled portion 45 of the spring 42. The uncurled end 47 of the spring 42 may extend through an opening 74 toward the bracket 44. In some embodiments, a ramp 73 having an inclined surface 75 may extend from the bottom end 66 toward the lower body 56 between the legs 58.

The upper body 54 may also include a projection 76 and a slot 81 disposed at the top end 64 (FIG. 2). The projection 76 may include a generally I-shaped cross-section having upper and lower flanges 78, 80 and a body 82 extending therebetween. The slots 81 may be sized and shaped to enable the slots 81 of the first housing portion 50 and the second housing portion 52 to slidably engage the lower flanges 80 of the second housing portion 52 and the first housing portion 50, respectively. The lower flanges 80 may be securely received in the corresponding slots 78 by a snap fit, a press fit, a fastener and/or adhesive, for example, or any other suitable attachment means.

As shown in FIG. 2, the lower body 56 may include a top end 88, a bottom end 90, a first side 92, and a second side 94. An aperture 96 may extend through the lower body 56 and may rotatably engage the cam 48. A first slot 98 in communication with the aperture 96 may extend through the exterior and interior faces 84, 86 and may extend vertically upward from the aperture 96 through the top end 88.

The lower body 56 may include a barbed protuberance 100 disposed at or proximate to the first side 92. A second slot 104 may be formed in the second side 94 generally opposite the barbed protuberance 100. In this manner, when the first and second housing portions 50, 52 are assembled together, the barbed protuberances 100 may engage the second slots 104. The engagement between the barbed protuberances 100 and second slots 104 may be configured to allow the lower bodies 56 of the first and second housing portions 50, 52 to be movable relative to each other between a first position (corresponding to a tilted position of the lower sash 14) and a second position (corresponding to an upright position of the lower sash 14) without disengaging each other in a similar manner as described in Assignee's commonly owned U.S. Pat. No. 8,561,260, the disclosure of which is incorporated by reference herein.

The legs 58 may interconnect the upper and lower bodies 54, 56 and may be integrally formed therewith. The legs 58 may be spaced apart from each other and may define a channel 107 therebetween. The channel 107 may be aligned with the ramp 73 of the upper body 54 and with the first slot 98 and aperture 96 of the lower body 56.

The legs 58 may be resiliently flexible members having thicknesses that may be relatively thin compared to the thicknesses of the upper and lower bodies 54, 56. This provides additional flexibility for the legs 58 to resiliently bend and flex about one or more horizontal axes. In some embodiments, the flexibility of the legs 58 may facilitate twisting of the carrier 40 about a vertically extending axis that extends vertically through the central portions of the carrier 40 and the bracket 44.

The cam 48 may be an elliptic cylinder having a pair of slots 118 on opposite sides of the cam 48. Either of the slots 118 of the cam 48 of each of the window balance assemblies 20 can receive one of the pivot bars 22 extending from the lower sash 14. The cam 48 may be rotatable within the aperture 96 between an unlocked position corresponding to an upright position of the lower sash 14 and a locked position corresponding to a tilted position of the lower sash 14. Rotation of the cam 48 may allow the lower sash 14 to pivot about a longitudinal axis of the pivot bar 22 between the upright position and the tilted position.

When the cam 48 is rotated into the locked position, the elliptical shape of the cam 48 causes the lower bodies 56 of the first and second housing portions 50, 52 of the carrier 40 to move outward away from each other (but without disengaging each other), as described above. With the lower bodies 56 moved outward, the exterior faces 84 of the lower bodies 56 may be forced against third and fourth walls 32, 34 of the jamb channel 26, thereby increasing the friction between the carrier 40 and the jamb channel 26 to lock the carrier 40 relative to the jamb channel 26. As shown in FIG. 2, when the cam 48 is in the locked position, the slot 118 in the cam 48 may be substantially aligned with the channel 107 between the legs 58, the ramp 73 of the upper body 54, the first slot 98 and the aperture 96 of the lower body 56. This alignment allows for "drop-in" installation of the pivot bar 22 into the cam 48 while the carrier 40 is locked in place within the jamb channel 26.

When the cam 48 is in the unlocked position (i.e., oriented such that the slot 118 is oriented horizontally), the interior faces of the lower bodies 56 of the carrier 40 may move toward each other (i.e., return to the unlocked or unrestricted position), such that the carrier 40 may be generally unrestricted from moving upward and downward in the window jamb channel 26 as the lower sash 14 moves between the open and closed positions.

It will be appreciated that the carrier 40 and cam 48 can be of any other suitable type and/or configuration. For example, the carrier 40 and cam 48 can be similar to one of the types disclosed in Assignee's commonly owned U.S. Pat. No. 8,561,260, the disclosure of which is incorporated by reference herein.

Figure 3:
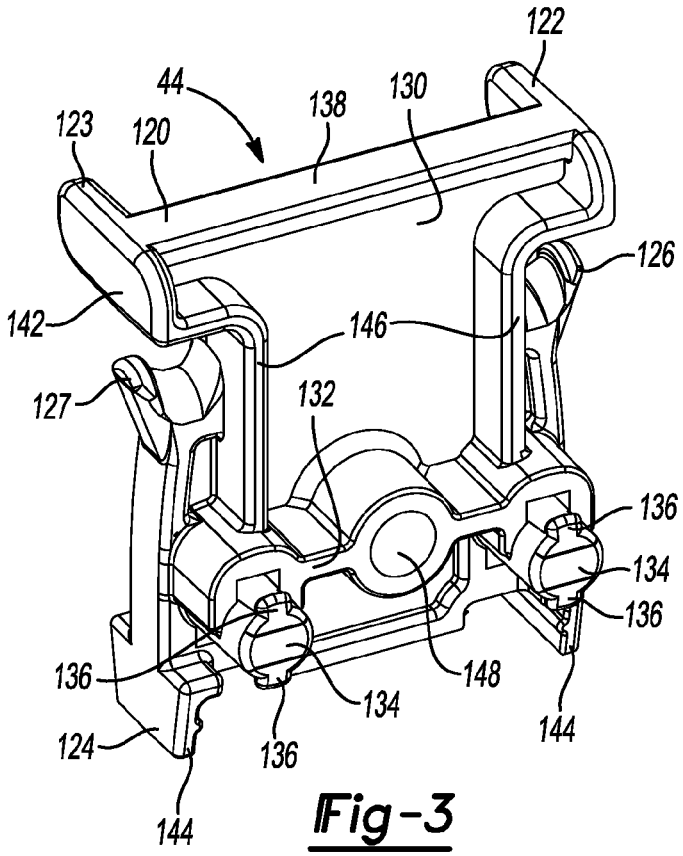
FIG. 3 is a perspective view of a mounting bracket of the window balance assembly.

Referring now to FIGS. 2-5, the bracket 44 may be formed from a polymeric material and/or a metallic material, for example, and may include a body portion 120, first and second head portions 122, 123, a base 124, and first and second latches 126, 127. The body portion 120 may include a first side 128 (FIG. 2) and a second side 130 (FIG. 3). The second side 130 may include a bosses 132 (FIGS. 3-5) extending outward therefrom in a direction that is substantially perpendicular to the second side 130. The boss 132 may include a pair of generally cylindrical projections 134 that extend outward in the direction that is substantially perpendicular to the second side 130. Each of the projections 134 may include a pair of tabs 136 that extend outward from an end of the projection 134 in opposite directions that are substantially parallel to the second side 130. As shown in FIGS. 4 and 5, the projection 134 may be received through corresponding slots or apertures 137 in the second wall 30 of the jamb channel 26. One or both of the tabs 136 may engage an exterior side 139 of the second wall 30 when the projections 134 are received in the apertures 137 to restrict or prevent the projections 134 from backing out of the apertures 137. As shown in FIGS. 4 and 5, the boss 132 may abut an interior side 141 of the second wall 32 when the projections 134 are received in the apertures 137.

The first and second head portions 122, 123 may be disposed at or adjacent a top end 138 of the body portion 120. The first and second head portions 122, 123 may extend away from the first side 128 of the body portion 120 in a direction that is substantially perpendicular to the first side 128. As shown in FIG. 5, the first and second head portions 122, 123 may be sized and shaped so that tips 140 of the first and second head portions 122, 123 may contact (or nearly contact) the first wall 28 of the jamb channel 26 and outer faces 142 of the first and second head portions 122, 123 may contact (or nearly contact) the third and fourth walls 32, 34, respectively, of the jamb channel 26 when the bracket 44 is installed in the jamb channel 26. As shown in FIG. 5, the first and second head portions 122, 123 may cooperate with the first side 128 of the body portion 120 to form a U-shape to provide clearance for the tilt latch mechanism 24 when it extends into the slot 36 of the jamb channel 26.

The base 124 of the bracket 44 may include tabs 144 (FIG. 3) that extend downward away from the body portion 120. The base 124 may removably engage the upper flanges 78 of the projections 76 of the carrier 40. The engagement between the upper flanges 78 and the base 124 may be a snap or interference fit, for example. In some embodiments, the tabs 144 may slide and/or snap into and out of engagement with the projection 76 or breakaway from the projection 76 as the carrier 40 is pulled away from the bracket 44.

The first and second latches 126, 127 may extend generally upward and outward from opposite lateral edges 146 of the body portion 120 between the first and second head portions 122, 123 and the base 124. Either of the latches 126, 127 may engage an aperture 43 in the spring 42 (as shown in FIG. 2). The base 124 may extend laterally outward from the body portion 120 and may engage one of the projections 76 of the carrier 40, as shown in FIG. 2.

The first and second latches 126, 127 allow for the spring 42 to be attached on either side of the window balance assembly 20 (i.e., either adjacent the third wall 32 or adjacent the fourth wall 34 of the window jamb channel 26) according to a user's preference. For example, some users may prefer to have the springs 42 of both window balance assemblies 20 of a particular sash be facing an exterior of the building or some users may prefer to have the springs 42 of both window balance assemblies 20 facing an interior of the building depending on aesthetic preferences, for example. Because the bracket 44 includes the first and second latches 126, 127 disposed on opposite lateral edges 146 of the body portion 120, one of the window balance assemblies 20 for a particular sash can be configured such that the spring 42 is attached to the first latch 126 and the other one of the window balance assemblies 20 for the particular sash can be configured such that the spring 42 is attached to the second latch 127.

In some embodiments, a mounting aperture 148 may extend through the first and second sides 128, 130 and the boss 132. Optionally, a fastener (not shown) may be driven through the mounting aperture 148 and the second wall 30 of the jamb channel 26 to aid the projections 134 in securing the bracket 44 to the window jamb 16.

With reference to FIGS. 1, 4 and 5, a method of installing the window balance assembly 20 into the window assembly 10 will be described. Installation of the window balance assembly 20 may begin by inserting the window balance assembly 20 into the jamb channel 26. This can be done by inserting the window balance assembly 20 through an open end of the jamb channel 26 before the window jamb 16 is fastened to the window sill 18 and/or header of the window assembly 10, for example. Alternatively, the window balance assembly 20 can be inserted into the jamb channel 26 through a cutout 21 in the jamb channel 26 disposed between the upper and lower ends of the window jamb, as shown in FIG. 1. The window balance assembly 20 can be easily inserted into and removed from the jamb channel 26 through the cutout 21 even after the window jamb 16 is installed in the window frame (i.e., after the window jamb 16 is fixed to the window frame header and sill) without disassembling or removing the window jamb 16 from the window assembly 10.

After the window balance assembly 20 is received in the jamb channel 26, the bracket 44 can be secured to the second wall 30 of the jamb channel 26 and the pivot bar 22 connected to the lower sash 14 can be received into the cam 48, as described above. The bracket 44 can be secured to the second wall 30 by aligning the projections 134 with the apertures 137 of the second wall 30 and inserting the projections 134 through the apertures 137.

With the projections 134 received in the apertures 137, the tips 140 of the first and second head portions 122, 123 may contact (or nearly contact) the first wall 28 of the jamb channel 26 and outer faces 142 of the first and second head portions 122, 123 may contact (or nearly contact) the third and fourth walls 32, 34, respectively, of the jamb channel 26, as described above and shown in FIG. 5. As shown in FIG. 4, the first and second latches 126, 127 are disposed vertically between the projections 134 and the first and second head portions 122, 123. In this manner, the first and second head portions 122, 123 may cooperate with the projections 134 and the boss 132 to restrict or prevent the bracket 44 from pivoting or rotating relative to the jamb channel 26 in response to a force being exerted on one of the latches 126, 127 by the spring 42 and carrier 40 (i.e., due to the lower sash 14 being moved toward the closed position) or in response to a reduction of force exerted on one of the latches 126, 127 by the spring 42 and carrier 40 (i.e., due to the lower sash 14 being moved toward the open position). Further, the fact that the bracket 44 includes the pair of projections 134 (rather than just a single projection 134) also restricts rotation of the bracket 44. Restricting or preventing the bracket 44 from pivoting or rotating in these manners may restrict or prevent the bracket 44 from being unintentionally disengaged from the second wall 30 of the jamb channel 26.

Figure 6:
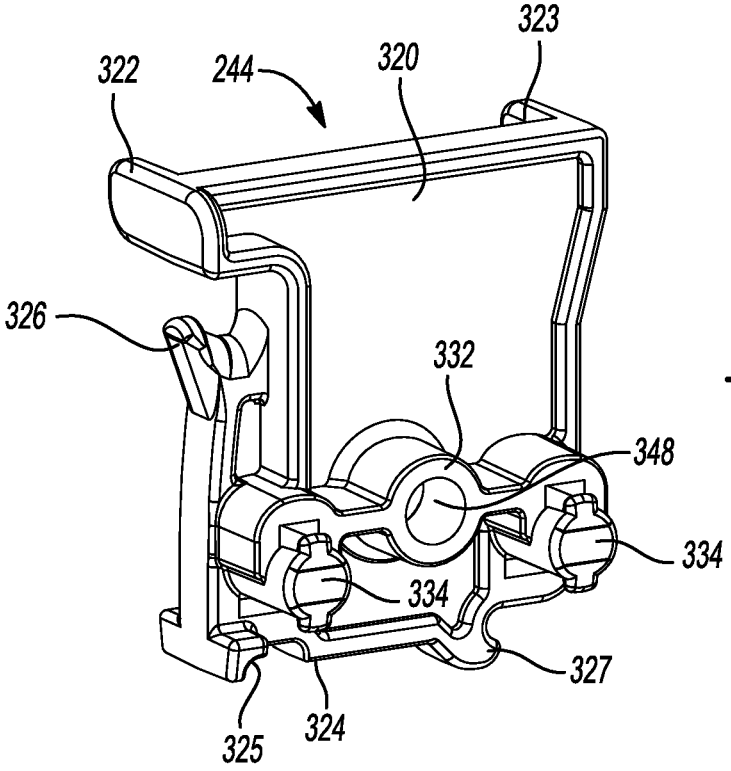
FIG. 6 is a perspective view of another mounting bracket.
Figure 7:
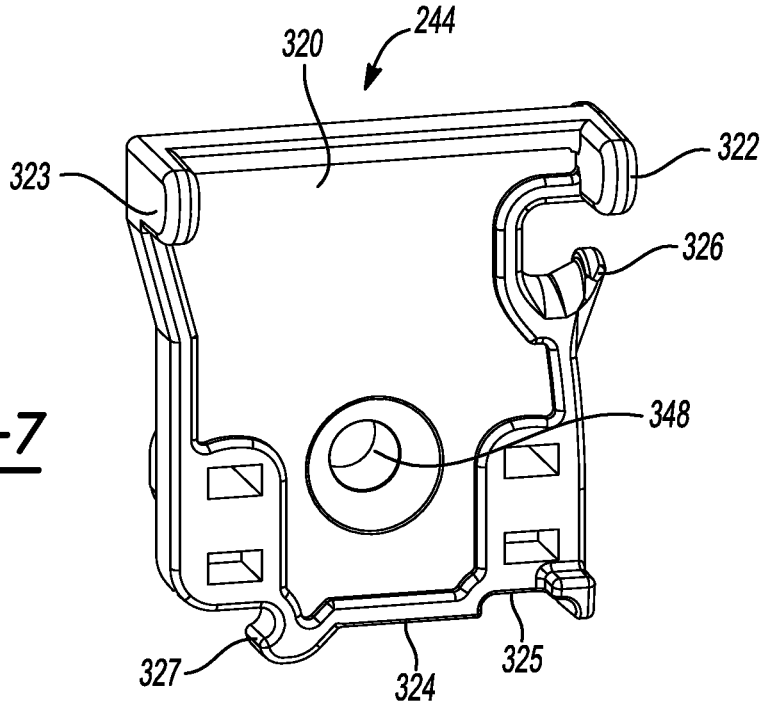
FIG. 7 is another perspective view of the mounting bracket of FIG. 6.

With reference to FIGS. 6 and 7, another bracket 244 is provided. The bracket 244 could be incorporated into the window balance assembly 20 in place of the bracket 44. The structure and function of the bracket 244 may be substantially similar to that of the bracket 44 described above, apart from any exceptions noted below. Therefore, similar features will not be described again in detail.

Briefly, the bracket 244 may include a body portion 320, first and second head portions 322, 323, a base 324, and a single latch 326. The body portion 320 may include a boss 332 having a pair of projections 334 extending outwardly therefrom. In some embodiments, an aperture 348 may extend through the body portion 320 and the boss 332.

The base 324 may releasably engage the projections 76 of the carrier 40 in a manner described in Assignee's commonly owned U.S. Pat. No. 8,561,260, the disclosure of which is incorporated by reference. For example, the base 324 may include a recess 325 and a tab 327. The recess 325 may be disposed generally beneath the latch 326 and may receive one of the projections 76 of the carrier 40. The tab 327 may engage an underside of the upper flange 78 of the other one of the projections 76 of the carrier 40. Downward force exerted on the latch 326 by the spring 42 may maintain the engagement between the base 324 and the projections 76. It will be appreciated the base 324 may be configured similarly to the base 124 or any other base portion described in U.S. Pat. No. 8,561,260.

Figure 8:
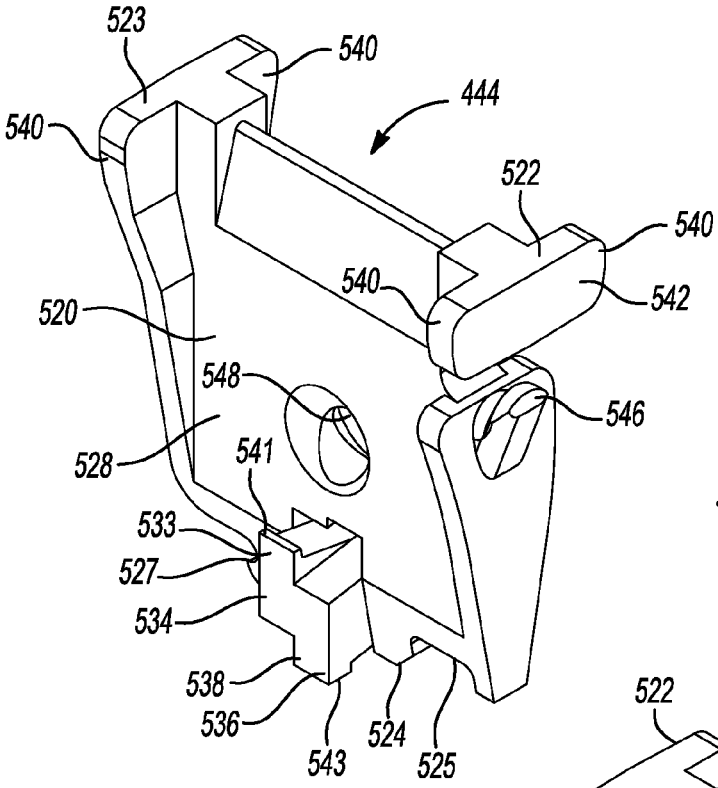
FIG. 8 is a perspective view of another mounting bracket.
Figure 9:
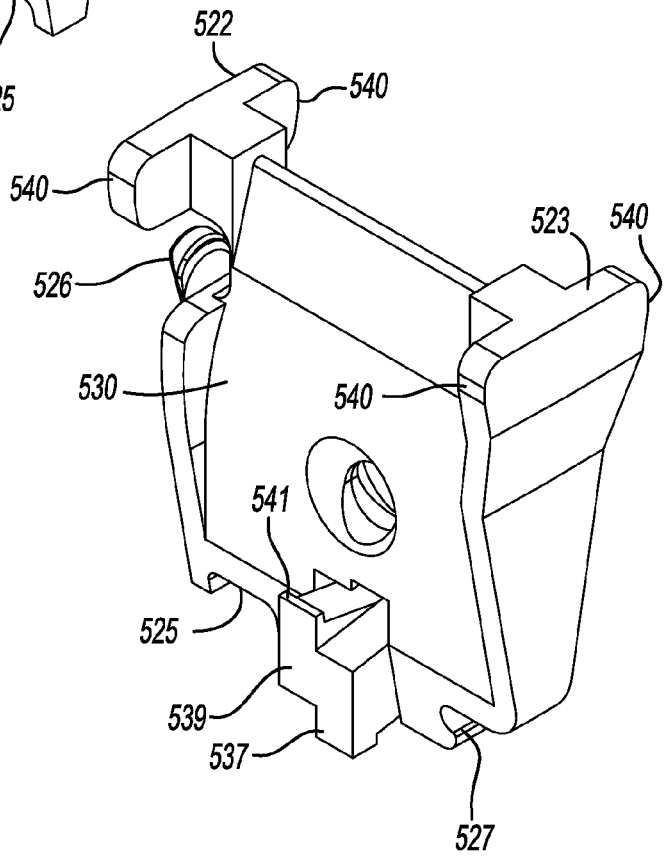
FIG. 9 is another perspective view of the mounting bracket of FIG. 8.
Figure 10:
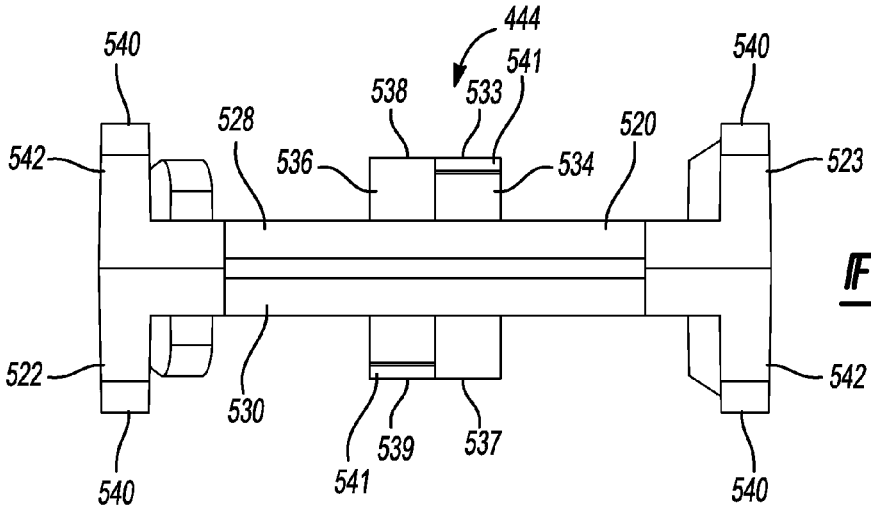
FIG. 10 is a top view of the mounting bracket of FIG. 8.

With reference to FIGS. 8-10, another bracket 444 is provided. The bracket 444 could be incorporated into the window balance assembly 20 in place of the bracket 44. The structure and function of the bracket 444 may be generally similar to that of the bracket 44 described above, apart from any exceptions noted below. Therefore, similar features will not be described again in detail.

The bracket 444 may include a body portion 520, first and second head portions 522, 523, a base 524, and a latch 526. The body portion 520 may include a first side 528 (FIG. 8), a second side 530 (FIG. 9), and first and second projections 534, 535. In some embodiments, the first and second projections 534, 536 may be integrally formed with each other. A first end 533 of the first projection 534 and a second end 538 of the second projection 535 extend outward from the first side 528. A second end 537 of the first projection 534 and a first end 539 of the second projection 536 extend outward from the second side 530. The first ends 533, 539 may include an upwardly extending tab 541. The second ends 537, 538 may include a downwardly extending tab 543. The projections 534, 536 may be received through an aperture in the second wall 30 of the jamb channel 26. One or both of the tabs 541, 543 may engage the exterior side 139 of the second wall 30 when the projections 534, 536 are received in the aperture to restrict or prevent the projections 534, 536 from backing out of the aperture. In some embodiments, a mounting aperture 548 may extend through the body portion 520 above the projections 534, 536.

The first and second head portions 522, 523 may be disposed at or adjacent a top end of the body portion 520. The first and second head portions 522, 523 may extend away from the first and second sides 528, 530 of the body portion 520 in a direction that is substantially perpendicular to the body portion 520, as shown in FIG. 10. The first and second head portions 522, 523 may be sized and shaped so that tips 540 of the first and second head portions 522, 523 may contact (or nearly contact) the first and second walls 28, 30 of the jamb channel 26 and outer faces 542 of the first and second head portions 522, 523 may contact (or nearly contact) the third and fourth walls 32, 34 of the jamb channel 26 when the bracket 444 is installed in the jamb channel 26.

The base 524 may releasably engage the projections 76 of the carrier 40 in a manner described above. For example, the base 524 may include a recess 525 and a tab 527 that may be substantially similar to the recess 325 and tab 327 described above.

With the bracket 444 incorporated into the window balance assembly 20, the window balance assembly 20 is a non-handed assembly. That is, two identical window balance assemblies 20 each having the bracket 444 can be used on either of the right-hand and left-hand sides of the lower sash 14 and with either side of the window balance assembly 20 facing the lower sash 14 (i.e., with either the first housing portion 50 or the second housing portion 52 facing the lower sash 14) without changing the function, structure, configuration or arrangement of the components of the window balance assemblies 20, the window jambs 16, the sashes 12, 14 or any other component of the window assembly 10.

Figure 11:
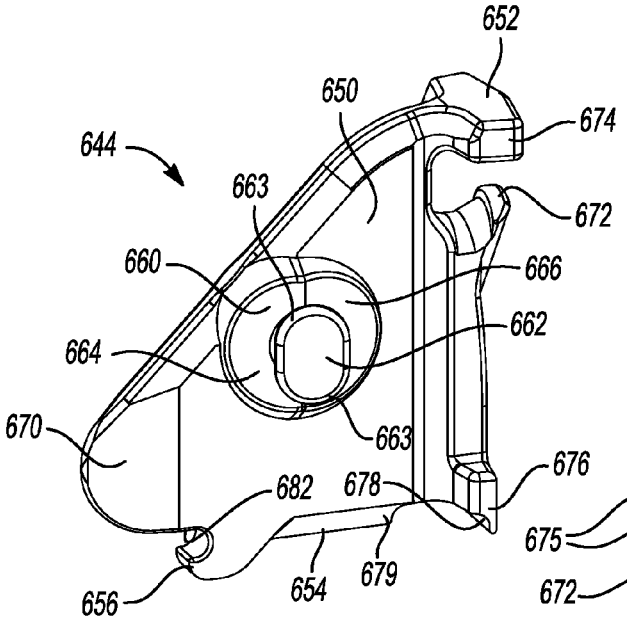
FIG. 11 is a perspective view of another mounting bracket.
Figure 12:
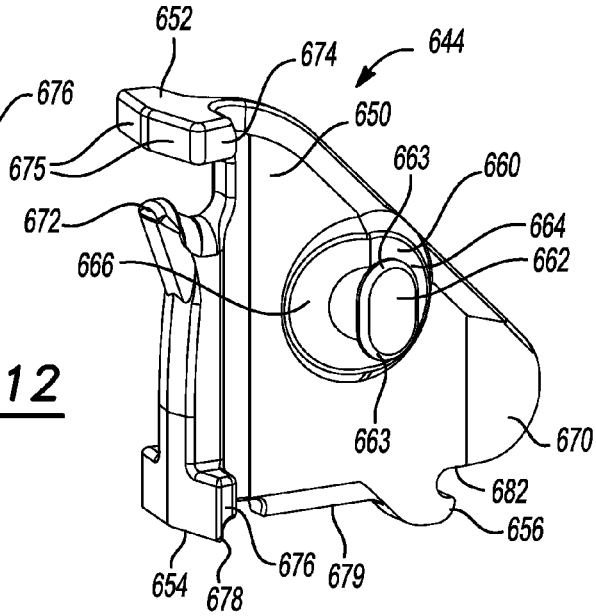
FIG. 12 is another perspective view of the mounting bracket of FIG. 11.
Figure 13:
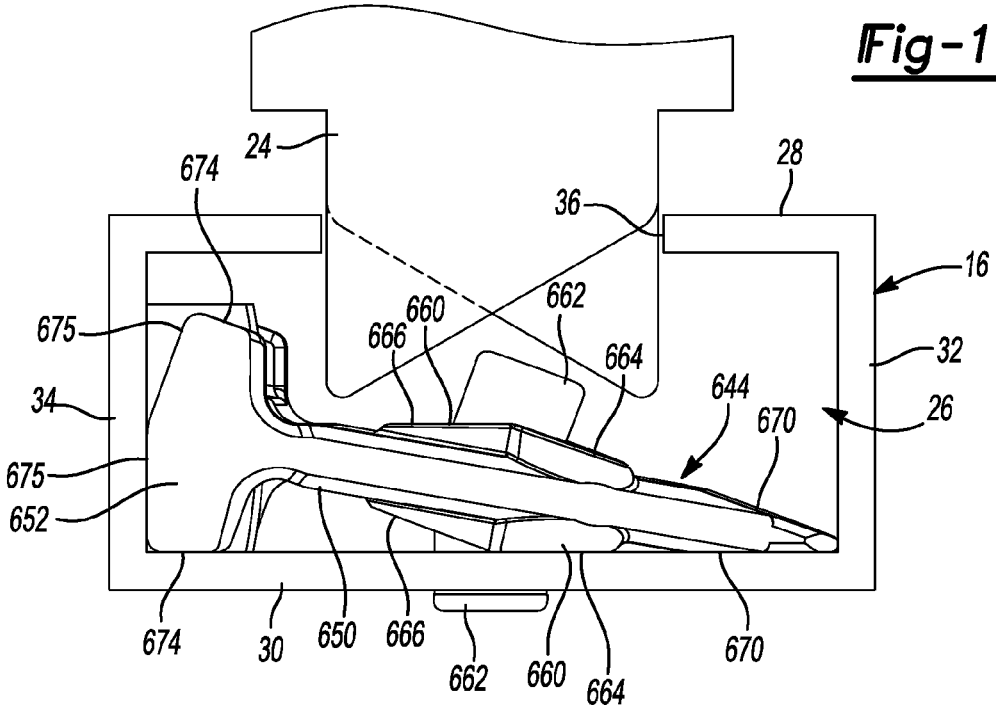
FIG. 13 is a top view of the mounting bracket of FIG. 11 installed in a window jamb channel.

With reference to FIGS. 11-13, another bracket 644 is provided. The bracket 644 could be incorporated into the window balance assembly 20 in place of the bracket 44. The mounting bracket 644 may include a body portion 650, a head 652, a base 654, and a tab 656. The mounting bracket 644 may be substantially symmetric about a plane defining the body portion 650 and extending through the head 652, base 654, and tab 656.

The body portion 650 may include a pair of bosses 660 disposed on opposite sides of the body portion 650. Each of the bosses 660 may include a projection 662 extending therefrom. Each of the projections 662 may include a pair of tabs 663 extending in opposite directions. Either of the projections 662 may engage an aperture in the second wall 30 of the jamb channel 26, as described above. The tabs 663 may reduce or prevent the projection 662 from backing out of the aperture in the second wall 30 and unintentionally disengaging the bracket 644 from the second wall 30.

Each of the bosses 660 may include first and second surfaces 664, 666 disposed at non-perpendicular angles relative to each other. The body portion 650 may also include a pair of tapered surfaces 670. Each tapered surface 670 may be substantially coplanar with the first surface 664 on the corresponding side of the body portion 650 (see FIG. 13). A latch 672 may extend generally upward and outward from the body portion 650 between the head 652 and the base 654. The latch 672 may engage the aperture 43 in the spring 42.

The head 652 may extend laterally outward from the body portion 650 and may include a pair of third surfaces 674 and a pair of fourth surfaces 675. Each of the third surfaces 674 may be substantially coplanar with the first surface 664 and tapered surface 670 on the corresponding side of the body portion 650. One of the third surfaces 674 may abut the second wall 30 of the jamb channel 26 when the mounting bracket 644 is installed therein, as shown in FIG. 13. Each of the fourth surfaces 675 may be substantially perpendicular to an adjacent one of the third surfaces 674. As shown in FIG. 13, one of the fourth surfaces 675 may contact or nearly contact one of the third wall 32 and the fourth wall 34. An end of the tapered surfaces 670 may contact or nearly contact the other of the third wall 32 and the fourth wall 34. In this manner, the bracket 644 may be prevented from rotating about the projection 662 engaging the second wall 30.

The base 654 may extend laterally outward from the body portion 650 and may include a pair of fifth surfaces 676 and a leg portion 678. Each of the fifth surfaces 676 may be on laterally opposite ends of the base 654 and may be substantially coplanar with the first surface 664, third surface 674 and tapered surface 670 on the corresponding side of the body portion 650. The leg portion 678 may cooperate with a first lower surface 679 of the body portion 650 to form a recess receiving one of the projections 76 of the carrier 40.

The tab 656 may extend from a second lower surface 682 and may cooperate with the second lower surface 682 to engage at least a portion of the other of the projections 76 of the carrier 40. In some embodiments, the tab 656 may slidably engage the projection 76. In some embodiments, the tab 656 may snap into and out of engage with the projection 76 or breakaway from the projection 76.

The mounting bracket 644 may be symmetric in that it includes each of the first surface 664, tapered surface 670, third surface 674 and the fifth surface 676 on each side of the mounting bracket 644. This symmetry allows the mounting bracket 644, and hence the window balance assembly 20, to be non-handed.

Figure 14:
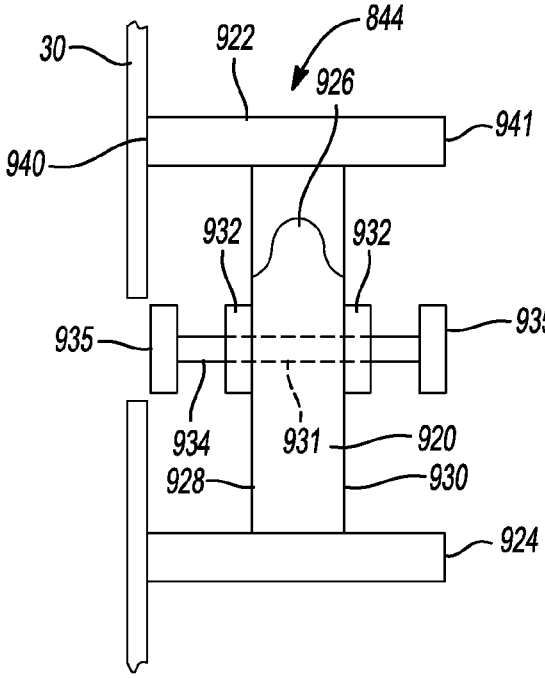
FIG. 14 is a side view of another mounting bracket received in the window jamb channel in a first configuration.
Figure 15:
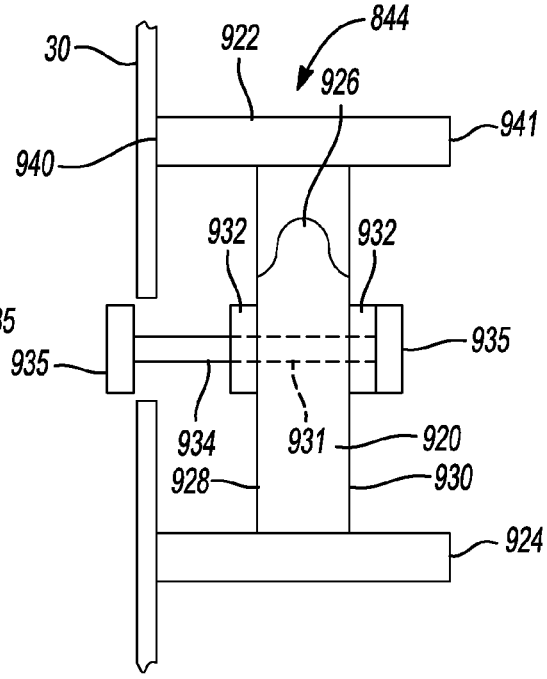
FIG. 15 is a side view of the mounting bracket of FIG. 14 received in the window jamb channel in a second configuration.

With reference to FIGS. 14 and 15, another bracket 844 is provided. The bracket 844 could be incorporated into the window balance assembly 20 in place of the bracket 44. The bracket 844 may include a body portion 920, a head portion 922, a base 924, and a latch 926.

The body portion 920 may include a first side 928 and a second side 930. Each of the first and second sides 928, 930 may include a bosses 932 extending outward therefrom. An aperture 931 may extend through both of the bosses 932 and the body portion 920. A peg 934 may be slidably received in the aperture 931 and may be movable therein between a disengaged position (FIG. 14) in which the peg 934 is generally centered in the aperture 931 and an engaged position (FIG. 15) in which the peg 934 is pushed out of one end of the aperture 931 so that the peg 934 may engage the aperture 137 in the second wall 30. Both ends of the peg 934 may include a flared portion 935 extending laterally outward therefrom. The flared portions 935 may be substantially parallel to the bosses 932 and may prevent the peg 934 from sliding out of the aperture 931 in the engaged position.

The head portion 922 may extend laterally from the body portion 920 in opposite directions to form a T-shape. When the bracket 844 is received in the jamb channel 26, a first end 940 of the head portion 922 may contact or nearly contact the second wall 30 and a second end 941 of the head portion 922 may contact or nearly contact the first wall 28.

The base 924 may extend laterally from the body portion 920 in opposite directions to form a T-shape. When the bracket 844 is received in the jamb channel 26, the base 924 may contact or nearly contact the first and second walls 28, 30. Like the brackets 44, 244, 444, 644, 844 described above, the base 924 may removably engage the carrier 40.

With the bracket 844 incorporated into the window balance assembly 20, the window balance assembly 20 is a non-handed assembly. The peg 934 can be pushed in either direction (i.e., to the left or right) from the disengaged position (FIG. 14) depending upon which side of the bracket 844 is facing the second wall 30.

In some embodiments, the peg 934 may be initially fixed to the body portion 920 by a breakaway connection in the disengaged position. In such embodiments, a user may break the breakaway connection by pushing the peg 934 toward the engaged position.

With reference to FIGS. 16-19, another window balance assembly 1020 is provided. The window balance assembly 1020 may be a fixed-coil balance assembly including a carrier module 1040, a spring module 1042, and a bracket module 1044. That is, the spring module 1042 is fixed relative to the jamb channel 26 during operation of the window balance assembly 1020.

The carrier module 1040 may include a body portion 1046 and a cam 1048. The body portion 1046 may include one or more latches 1050 configured to engage an uncurled end 1041 of a spring 1043 of the spring module 1042. The cam 1048 may be rotatably received in the body portion 1046 between a locked position to restrict movement of the carrier 1040 within the jamb channel 26 and an unlocked position to allow movement of the carrier 1040 within the jamb channel 26. In the locked position, the cam 1048 may force first and second housing portions of the carrier 1040 apart from each other to increase friction with the jamb channel 26, as described above. The body portion 1046 may include a channel 1051 that is aligned with the cam 1048 to allow for "drop-in" installation of the pivot bar 22 into the cam 1048 while the carrier 1040 is locked in place within the jamb channel 26.

The spring module 1042 may include a housing 1052 encasing a curled end 1045 of the spring 1043. A lower end of the housing 1052 may include a pair of projections 1054. The projections 1054 may slidably engage the bracket 1044.

Figure 16:
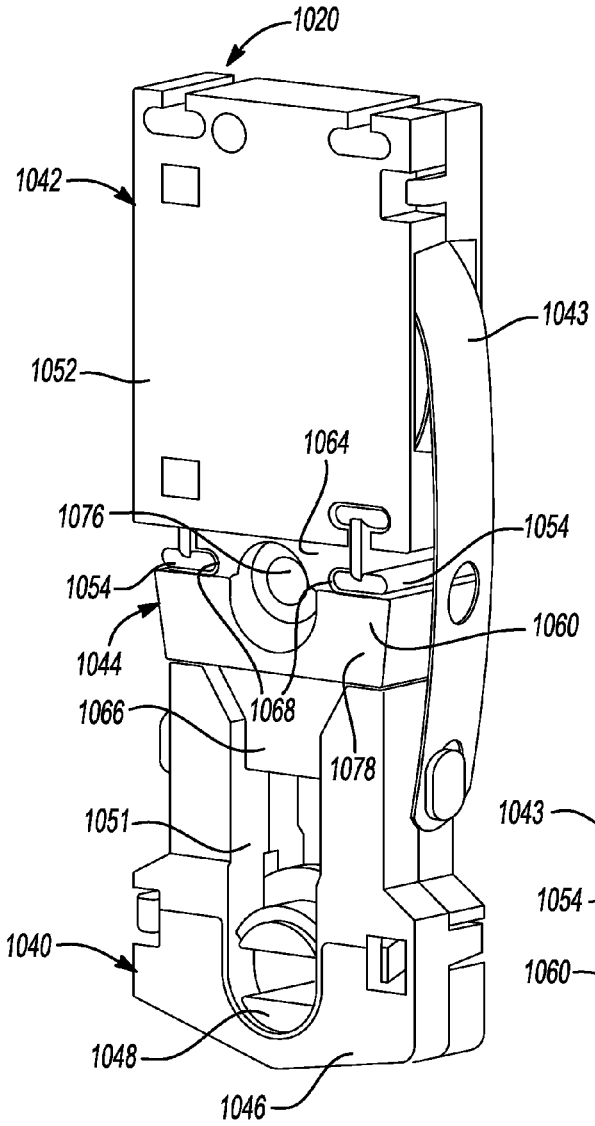
FIG. 16 is a perspective view of another window balance assembly.
Figure 17:
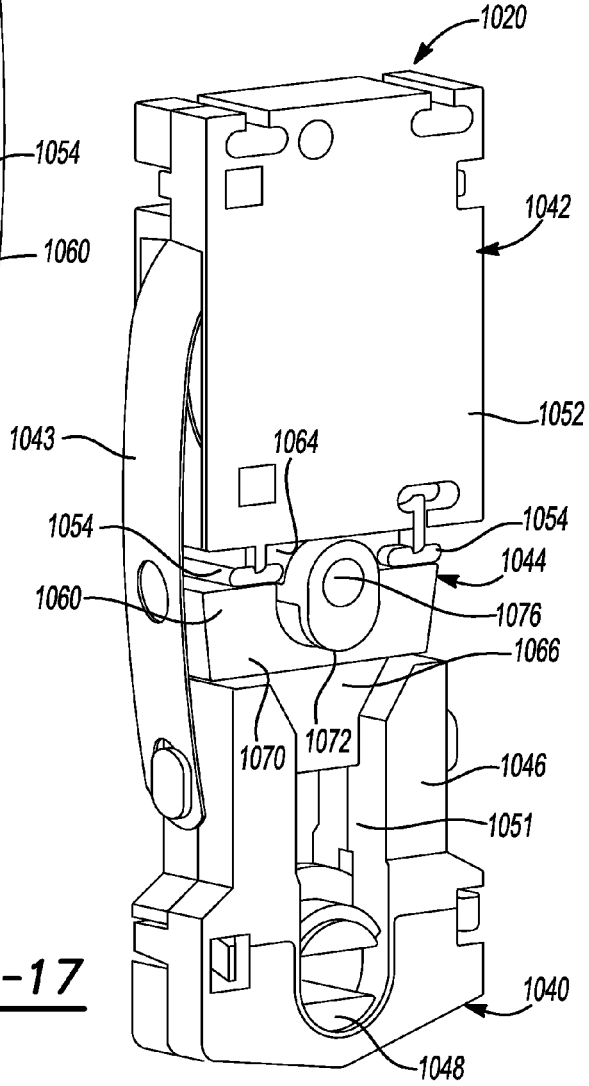
FIG. 17 is another perspective view of the window balance assembly of FIG. 16.

The bracket module 1044 may include a body 1060 and a projection 1062. The body 1060 may include an upper portion 1064 and a lower portion 1066. The upper portion 1064 may include a pair of recesses 1068 (FIG. 16) that slidably receive the projections 1054 of the spring module 1042. The lower portion 1066 may be tapered and is shown in FIGS. 16 and 17 as be received in the channel 1051 of the carrier 1040 (it will be appreciated that during operation of the window balance assembly 1020, the carrier 1040 can be separated from the bracket module 1044 as the sash 14 is moved up and down).

Figure 19:
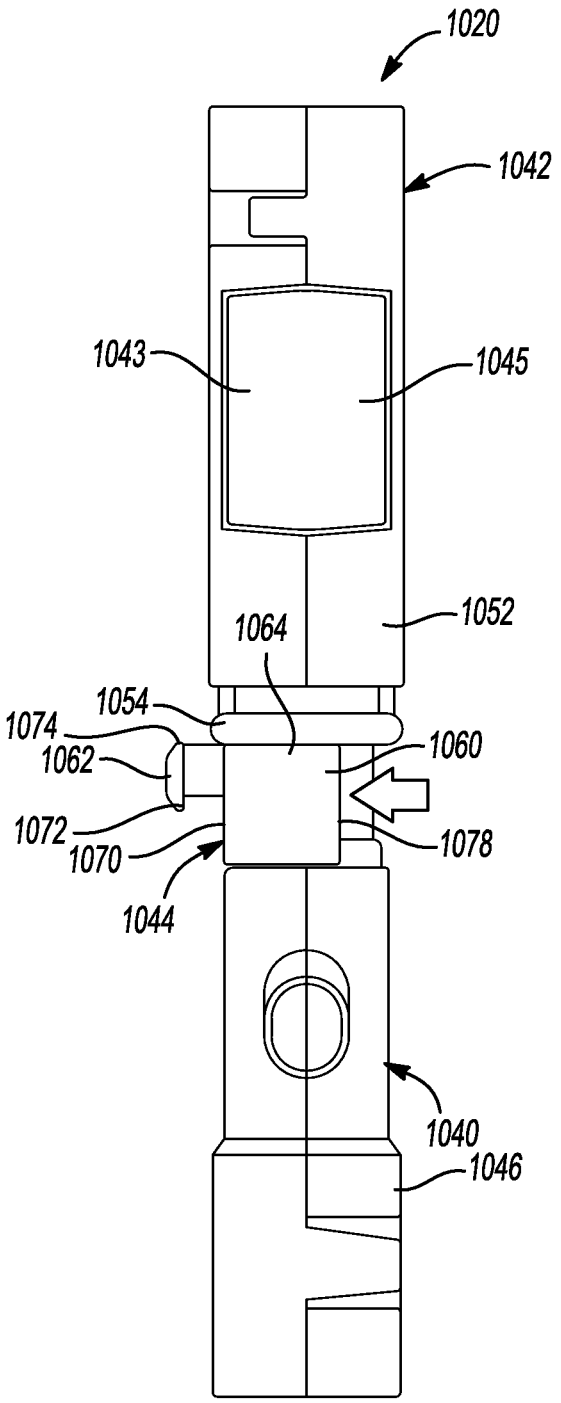
FIG. 19 is a side view of the window balance assembly of FIG. 16 in a second configuration.

The projection 1062 may be a generally cylindrical member extending from a first side 1070 of the body 1060. A distal end of the projection 1062 may include a downwardly extending flange 1072 and an upwardly extending tab 1074 (FIG. 19). In some embodiments, an aperture 1076 may extend though the projection 1062 and a second side 1078 of the body 1060.

Figure 18:
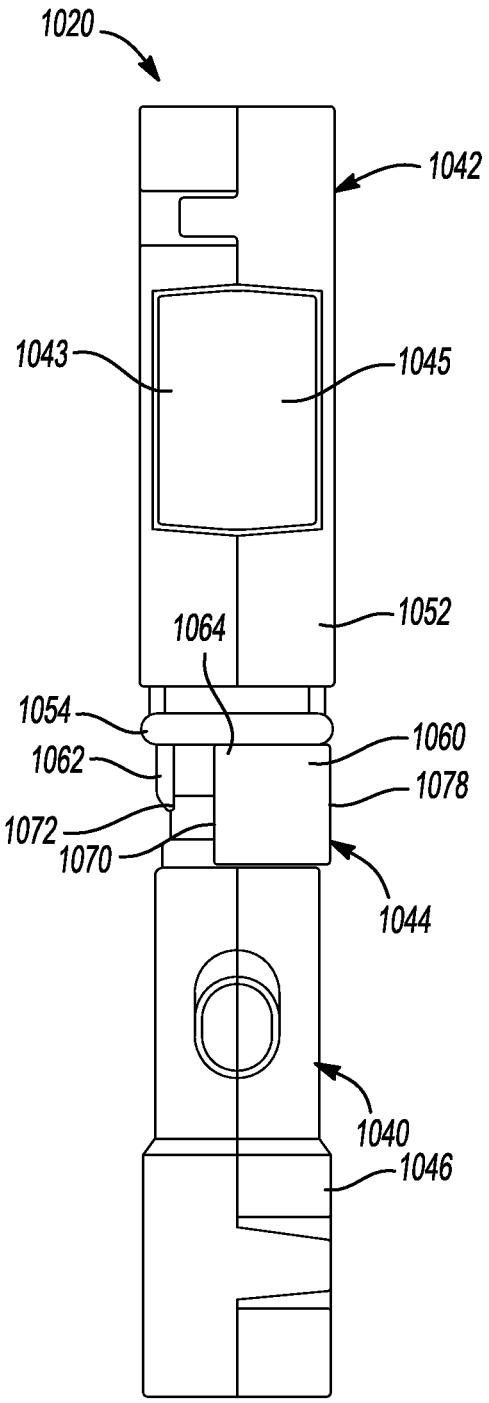
FIG. 18 is a side view of the window balance assembly of FIG. 16 in a first configuration.

With reference to FIGS. 18 and 19, a method of installing the window balance assembly 1020 into the jamb channel 26 will be described. Installation of the window balance assembly 1020 may begin by inserting the window balance assembly 1020 into the jamb channel 26. This can be done by inserting the window balance assembly 1020 through an open end of the jamb channel 26 before the window jamb 16 is fastened to the window sill 18 and/or header of the window assembly 10, for example. Alternatively, the window balance assembly 1020 can be inserted into the jamb channel 26 through the cutout 21 in the jamb channel 26 disposed between the upper and lower ends of the window jamb, as shown in FIG. 1.

After the window balance assembly 1020 is received in the jamb channel 26, the bracket 1044 can be secured to the second wall 30 of the jamb channel 26 and the pivot bar 22 connected to the lower sash 14 can be received into the cam 1048, as described above. The bracket 1044 can be secured to the second wall 30 by aligning the projection 1062 with an aperture of the second wall 30. Thereafter, the user may push the bracket 1044 relative to the spring module 1042 and carrier module 1040 from a retracted position (shown in FIG. 18) to an extended position (shown in FIG. 19). Moving the bracket 1044 into the extended position may allow the projection 1062 to be inserted into the aperture of the second wall 30. The flange 1072 and tab 1074 may restrict or prevent the bracket 1044 from moving back to the retracted position once the projection 1062 has been fully received in the aperture in the second wall 30. In some embodiments, the user can also drive a screw or other fastener through the aperture 1076 of the bracket 1044 and into the window jamb 16 to assist in securing the bracket 1044 to the window jamb 16.

All of the brackets 44, 244, 444, 644, 844, 1044 described above are configured to be securely fixed within the jamb channel 26 without a screw, nail, rivet or other fastener and without adhesive or welding. However, it will be appreciated that a user could screw, nail, rivet, adhesively bond, or weld, one or more of the brackets 44, 244, 444, 644, 844, 1044 to the jamb channel 26 in addition to or instead of the attaching means described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A window balance assembly for installation in a window jamb channel, the window balance assembly comprising:

a carrier;

a spring element having first and second portions, the first portion coupled to the carrier; and a mounting bracket including a latch, a first head portion, and a first projection, the latch engaging the second portion of the spring element, the first head portion configured to abut a first wall of the window jamb channel when the window balance assembly is installed in the window jamb channel, the projection configured to extend through and engage an aperture in a second wall of the window jamb channel when the window balance assembly is installed in the window jamb channel, the projection disposed vertically between the latch and the carrier so that a moment generated by the spring element pulling on the latch biases the projection into the aperture in the second wall.

2. The window balance assembly of claim 1, wherein the latch is disposed vertically between the projection and the head portion.

3. The window balance assembly of claim 1, wherein the mounting bracket includes a second projection configured to engage another aperture in the second wall.

4. The window balance assembly of claim 1, wherein the mounting bracket includes a second head portion configured to abut the first wall of the window jamb channel.

5. The window balance assembly of claim 4, wherein the mounting bracket includes a pair of latches, and wherein each of the latches is disposed on a same end of the mounting bracket as a corresponding one of the first and second head portions.

6. The window balance assembly of claim 4, wherein the mounting bracket includes a body portion from which the latch, first and second head portions and the first projection extend, the first projection extending from a first side of the body portion in a first direction, the first and second head portions extending from the body portion in a second direction that is opposite the first direction.

7. The window balance assembly of claim 6, wherein the first projection is disposed between the first and second head portions.

8. The window balance assembly of claim 6, wherein the body portion is spaced apart from the first wall when the first and second head portions are contacting the first wall.

9. The window balance assembly of claim 6, wherein the projection is slidably received in an aperture in the body portion and is movable therein between a retracted position and an extended position.

10. The window balance assembly of claim 4, wherein the first and second head portions cooperate with a body portion of the mounting bracket to form a generally U-shape.

11. The window balance assembly of claim 4, wherein the first head portion is configured to abut a third wall of the window jamb channel and the second head portion is configured to abut a fourth wall of the window jamb channel, the third and fourth walls being opposite each other, and the first and second walls being opposite each other.

12. The window balance assembly of claim 1, wherein the carrier includes an upper body portion, a lower body portion and an elongated central portion, the lower body portion rotatably engaging a cam, the elongated central portion extending between the upper body portion and the lower body portion, the elongated central portion being resiliently flexible to allow movement of the lower body portion relative to the upper body portion.

13. A window balance assembly for installation in a window jamb channel, the window balance assembly comprising:

a carrier;

a spring element having first and second portions, the first portion coupled to the carrier; and a mounting bracket including a latch, a first head portion, and a first projection, the latch engaging the second portion of the spring element, the first head portion configured to abut a first wall of the window jamb channel when the window balance assembly is installed in the window jamb channel, the projection configured to extend through and engage an aperture in a second wall of the window jamb channel when the window balance assembly is installed in the window jamb channel, wherein the carrier includes an upper body portion, a lower body portion and an elongated central portion, the lower body portion rotatably engaging a cam, the elongated central portion extending between the upper body portion and the lower body portion, the elongated central portion being resiliently flexible to allow movement of the lower body portion relative to the upper body portion, wherein the elongated central portion includes a pair of flexible legs that define a channel therebetween that is aligned with a slot in the cam and adapted to receive a portion of a pivot bar of a window sash.

14. The window balance assembly of claim 13, wherein the projection is disposed vertically between the latch and the carrier so that a moment generated by the spring element pulling on the latch biases the projection into the aperture in the second wall.

15. A window balance assembly for installation in a window jamb channel, the window balance assembly comprising:

a carrier;

a spring element having first and second portions, the first portion coupled to the carrier; and a mounting bracket including a body portion, first and second head portions, and first and second projections, the body portion including a latch engaging the second portion of the spring element, the first and second head portions extending from the body portion in a first direction and configured to abut a first wall of the window jamb channel when the window balance assembly is installed in the window jamb channel, the first and second projections extending from the body portion in a second direction and configured to extend through and engage first and second apertures in a second wall of the window jamb channel when the window balance assembly is installed in the window jamb channel, the first and second projections disposed vertically between the latch and the carrier so that a moment generated by the spring element pulling on the latch biases the first and second projections into the first and second apertures in the second wall.

16. The window balance assembly of claim 15, wherein the latch is disposed vertically between the first and second projections and the first and second head portions.

17. The window balance assembly of claim 16, wherein the first and second head portions are disposed at opposite horizontal ends of the body portion, and the latch is disposed between the first and second head portions.

18. The window balance assembly of claim 15, wherein the mounting bracket includes a pair of latches, and wherein each of the latches is disposed on a same end of the body portion as a corresponding one of the first and second head portions.

19. The window balance assembly of claim 15, wherein the body portion is spaced apart from the first wall when the first and second head portions are contacting the first wall.

20. A window balance assembly for installation in a window jamb channel comprising an aperture in a wall thereof, the window balance assembly comprising:

a carrier having a cam rotatably housed therein;

a spring element having a first portion coupled to the carrier and a second portion disposed within a housing; and a mounting bracket removably engaging the carrier and including a body portion and a peg extending through the body portion, the peg slidably movable relative to the body portion in one of a first direction and a second direction from a first position to a second position; and wherein in the first position the peg is inoperable to engage the aperture and in the second position the peg is operable to engage the aperture.

21. The window balance assembly of claim 20, wherein the mounting bracket further comprises a breakaway portion connecting the peg to the body portion when the peg is in the first position; and wherein the breakaway portion is broken when the peg is moved from the first position to the second position.

22. The window balance assembly of claim 21, wherein the spring is a curl spring and the second portion of the spring is a curled portion, and wherein the carrier is movable with a window sash relative to the housing and the mounting bracket.

* * * * *